US005483031A

United States Patent [19]

Matsuda

[11] Patent Number: 5,483,031

[45] Date of Patent: Jan. 9, 1996

[54] GAS-INSULATED DISCONNECTOR PROVIDED WITH STRUCTURE FOR SUPPRESSING METAL PARTICLES CONTAMINATION

[75] Inventor: Setsuyuki Matsuda, Amagasaki, Japan

[73] Assignee: Mitsubishi Denki Kabushiki Kaisha, Tokyo, Japan

[21] Appl. No.: 147,487

[22] Filed: Nov. 5, 1993

[30] Foreign Application Priority Data

Nov. 5, 1992 [JP] Japan ..... 4-295714

[51] Int. Cl.[6] ..... H01H 33/88

[52] U.S. Cl. ..... 218/48; 218/65; 218/74

[58] Field of Search ..... 200/144 R, 145, 200/148 R, 148 A, 148 B, 148 D, 148 F, 149 R, 150 R, 150 F, 149 A, 149 B; 218/43, 48, 49, 50, 51, 57, 59, 60, 61, 65, 68, 74, 77, 146

[56] References Cited

U.S. PATENT DOCUMENTS

| | | | |
|---|---|---|---|
| 3,254,185 | 5/1966 | Adkins | 200/148 |
| 4,236,053 | 11/1980 | Sasaki et al. | 200/144 R |
| 5,231,256 | 7/1993 | Yamagiwa et al. | 200/148 A |

FOREIGN PATENT DOCUMENTS 3-34608 4/1991 Japan .

*Primary Examiner*—Morris H. Nimmo
*Assistant Examiner*—Michael A. Friedhofer
*Attorney, Agent, or Firm*—Oblon, Spivak, McClelland, Maier & Neustadt

[57] ABSTRACT

A gas-insulated disconnector includes a movable contact disposed above a fixed contact within a housing filled with an insulating gas. The movable contact is electrically coupled to an upper support member through a finger-type sliding contact 3 which is dip-shaped and is fixed to the support member at the upper end thereof and is in sliding contact with the interior surface of the cup-shaped movable contact. An operating rod connecting the movable contact to a link mechanism is slidably supported by a support cylinder extending within the movable contact. Thus small metal particles generated by the abrasion of the contact surfaces at the side of the movable contact is contained within the movable contact and do not drift into the gas-insulated gap. Further, within the lower shield is disposed a particles remover near a fixed contact, and the small metal particles generated at a sliding contact surfaces of the movable contact 1 and the fixed contact are brushed off the surface of the movable contact 1 into the lower shield.

13 Claims, 6 Drawing Sheets

GAS-INSULATED DISCONNECTOR PROVIDED WITH STRUCTURE FOR SUPPRESSING METAL PARTICLES CONTAMINATION

BACKGROUND OF THE INVENTION

This invention relates to gas-insulated switchgears and more particularly to gas-insulated disconnectors provided with structures for suppressing the contamination of the insulating gas with the metal particles generated by the abrasion of the surfaces of contacts in sliding contact.

FIG. 6 is a sectional view of a conventional gas-insulated disconnector, which is disclosed, for example, in Mitsubishi Denki Gihou (Technical Journal of Mitsubishi Electric), Vol. 53, No. 10, p. 770, FIG. 5, Vol. 54, No. 6, p. 22, FIG. 6, and Vol. 51, No. 6, p. 380, FIG. 7.

To a movable contact 1 is coupled an operating rod 2. A tulip-type sliding contact 3 includes a helical spring 3*a* which bundles the contact plates 3*b* together and urges them upon the movable contact 1 and the top end portion of the support member 4, such that the sliding contact 3 ensures electrical connection between the sliding contact 3 and the support member 4. A Scott-Russel type link mechanism 5 converts the rotational motion around the rotational axis 6, which is disposed perpendicular to the sheet of the drawing, into the linear vertical motion of the operating rod 2. An operation device (not shown) is coupled to the rotational axis 6 through an electrically insulating rotation rod (not shown). A shield 7 surrounding the movable contact 1 and the support member 4 mollifies the electric field. When the movable contact 1 slides into a tulip-shaped fixed contact 10, a ring-shaped helical spring 10*a* urges the fixed contact 10 upon the movable contact 1, and the fixed contact 10 electrically couples the movable contact 1 and the support member 11. A shield 12 surrounding the fixed contact 10 mollifies the electric field.

Upper and lower insulating spacers 8, hermetically sealing upper and lower openings, respectively, of a housing 9 filled with an electrically insulating gas such as SF6, support central conductors 8*a* at the center thereof which are secured to the support member 4 and the support member 11, respectively. Sliding contacts 13 urged inwards by the helical springs 13*a* electrically connect the central conductors 8*a* to electrical conductors 14 and 15, respectively, of neighboring electrical apparatus. Shields 16 surrounding the respective sliding contacts 13 mollifies the electric field thereat.

In FIG. 6 the disconnector is shown in an open state. The making of the disconnector from the state shown in FIG. 6 proceeds as follows. Through the insulating rod, the operation device rotates the rotational axis 6 clockwise in the direction of the arrow A. The rotation of the rotational axis 6 is converted by means of the link mechanism 5 into an upward linear motion of the operating rod 2. Thus, the operating rod 2 moves upward together with the movable contact 1 until the head of the movable contact 1 is received into the fixed contact 10. The helical spring 10*a* urges the fixed contact 10 upon the movable contact 1 sliding thereinto, and the circuit between the upper conductor 14 and the lower conductor 15 is closed through: the upper sliding contact 13, the upper central conductor 8*a*, the support member 11, the fixed contact 10, the movable contact 1, the sliding contact 3, the support member 4, the lower central conductor 8*a*, and the lower sliding contact 13.

On the other hand, the breaking operation from the closed state is performed as follows. By means of the insulating rod and the operation device (not shown), the rotational axis 6 is rotated counter-clockwise in the direction opposite to the arrow A. The rotation is converted by means of the link mechanism 5 into a downward linear motion of the operating rod 2. Thus, the movable contact 1 moves downward with the operating rod 2 and leaves the fixed contact 10. Finally the movable contact 1 reaches the position shown in FIG. 6.

The conventional gas-insulated disconnector, however, has the following disadvantage. When the disconnector is made or opened, the operating rod 2 slides upon the fixed contact 10, the sliding contact 3 and the support member 4. The abrasion caused by the sliding movement between these metallic members generates small metal particles, which may drift into the insulating gas such as $SF_6$ filling the housing 9 to ensure insulation between the contacts 1 and 10, etc. The insulation efficiency is reduced by the contamination of the insulating gas with the metal particles. The deterioration of the insulation efficiency is all the more serious since the contacts are usually plated with silver to improve the conducting efficiency while the soft silver platings are easily abraded to produce contaminating small metal particles.

SUMMARY OF THE INVENTION

It is therefore an object of this invention to provide a gas-insulated disconnector by which the generation of the small metal particles and the contamination of the insulating gas with the drifting metal particles is effectively suppressed, and the insulation efficiency of the insulating gas is maintained at a good level.

The above object is accomplished in accordance with the principle of this invention by a gas-insulated switchgear for disconnecting an electrical connection between a first and a second outside conductors, wherein the gas-insulated switchgear comprises: a housing filled with an insulating gas; a fixed contact disposed within the housing and electrically coupled to the first outside conductor; an electrically conducting support member disposed within the housing and electrically coupled to the second outside conductor; a sliding contact secured on and electrically coupled to the support member; a cup-shaped movable contact in sliding contact with the sliding contact at an inner side surface thereof; and link means operatively coupled to the movable contact, for moving the movable contact between a first position electrically in contact with the fixed contact and a second position separated from the fixed contact across a gap filled with the insulating gas.

Preferably, the gas-insulated switchgear comprises: a shield substantially surrounding the fixed contact; and a particles remover disposed within the shield near the fixed contact for removing metal particles from an outer surface of the movable contact. It is further preferred that the gas-insulated switchgear comprises: an operating rod connecting the movable contact to the link means; and a support cylinder fixed to the support member and slidably supporting the operating rod, wherein the support cylinder is situated substantially within the movable contact while the movable contact is moved between the first and second positions.

Alternatively, the gas-insulated switchgear comprises: a housing filled with an insulating gas; a fixed contact disposed within the housing and electrically coupled to the first outside conductor; an electrically conducting support member disposed within the housing and electrically coupled to the second outside conductor; a sliding contact supported on and electrically coupled to the support member; a cylindrical movable contact in sliding contact with the sliding contact at an outer side surface thereof; link means operatively coupled to the movable contact, for moving the movable contact between a first position electrically in contact with the fixed contact and a second position separated from the fixed contact across a gap filled with the insulating gas; and an outer cylindrical cover fixed to the movable contact at a bottom end thereof and surrounding the movable contact across a gap, wherein portions of the sliding contact in sliding contact with the movable contact are received within the gap between the movable contact and the outer cylindrical cover while the movable contact is moved between the first and second positions.

Preferably, the sliding contact includes contact fingers supported at a base of the sliding contact in forms of cantilevers, the base of the sliding contact being fixed to the support member. It is further preferred that the diameter of the outer side surface of the movable contact is stepped with a predetermined reduction except for a predetermined length of an end portion of the movable contact situated away from the fixed contact.

Preferably, the support member includes a cylindrical projection; and the sliding contact includes a ring-shaped sliding contact member supported on and electrically in contact with an end of the projection, the ring-shaped sliding contact member being in sliding contact with the movable contact. Further, an outer support cylinder is fixed to the support member and surrounds the cylindrical projection, and rollers rotatably supported at an end of the outer support cylinder to roll upon an outer side surface of the outer cylindrical cover to translatably support the outer cylindrical cover.

Still alternatively, the gas-insulated switchgear comprises: a housing filled with an insulating gas; a fixed contact disposed within the housing and electrically coupled to the first outside conductor; an electrically conducting support member disposed within the housing and electrically coupled to the second outside conductor; a cylindrical sliding electrode coupled to the support member at a base thereof; a movable contact disposed in the housing; a sliding contact supported on the movable contact and in sliding contact with the cylindrical sliding electrode; link means operatively coupled to the movable contact, for moving the movable contact between a first position electrically in contact with the fixed contact and a second position separated from the fixed contact across a gap filled with the insulating gas; and an outer cylindrical cover fixed to the movable contact at a bottom end thereof and surrounding the sliding contact, wherein portions of the sliding contact in sliding contact with the movable contact are received within the outer cylindrical cover while the movable contact is moved between the first and second positions.

Still alternatively, the gas-insulated switchgear comprises: a housing filled with an insulating gas; a fixed contact disposed within the housing and electrically coupled to the first outside conductor; an electrically conducting support member disposed within the housing and electrically coupled to the second outside conductor; a movable contact disposed within the housing; link means operatively coupled to the movable contact, for moving the movable contact between a first position electrically in contact with the fixed contact and a second position separated from the fixed contact across a gap filled with the insulating gas; and flexible conductors electrically connecting the movable contact with the support member.

BRIEF DESCRIPTION OF THE DRAWINGS

The features which are believed to be characteristic of this invention are set forth with particularity in the appended claims. The structure and method of operation of this invention itself, however, will be best understood from the following detailed description, taken in conjunction with the accompanying drawings, in which:

In the drawings, like reference numerals represent like or corresponding parts or portions.

DETAILED DESCRIPTION OF THE PREFERRED EMBODIMENTS

Referring now to the accompanying drawings, the preferred embodiments of this invention are described.

Figure 1:
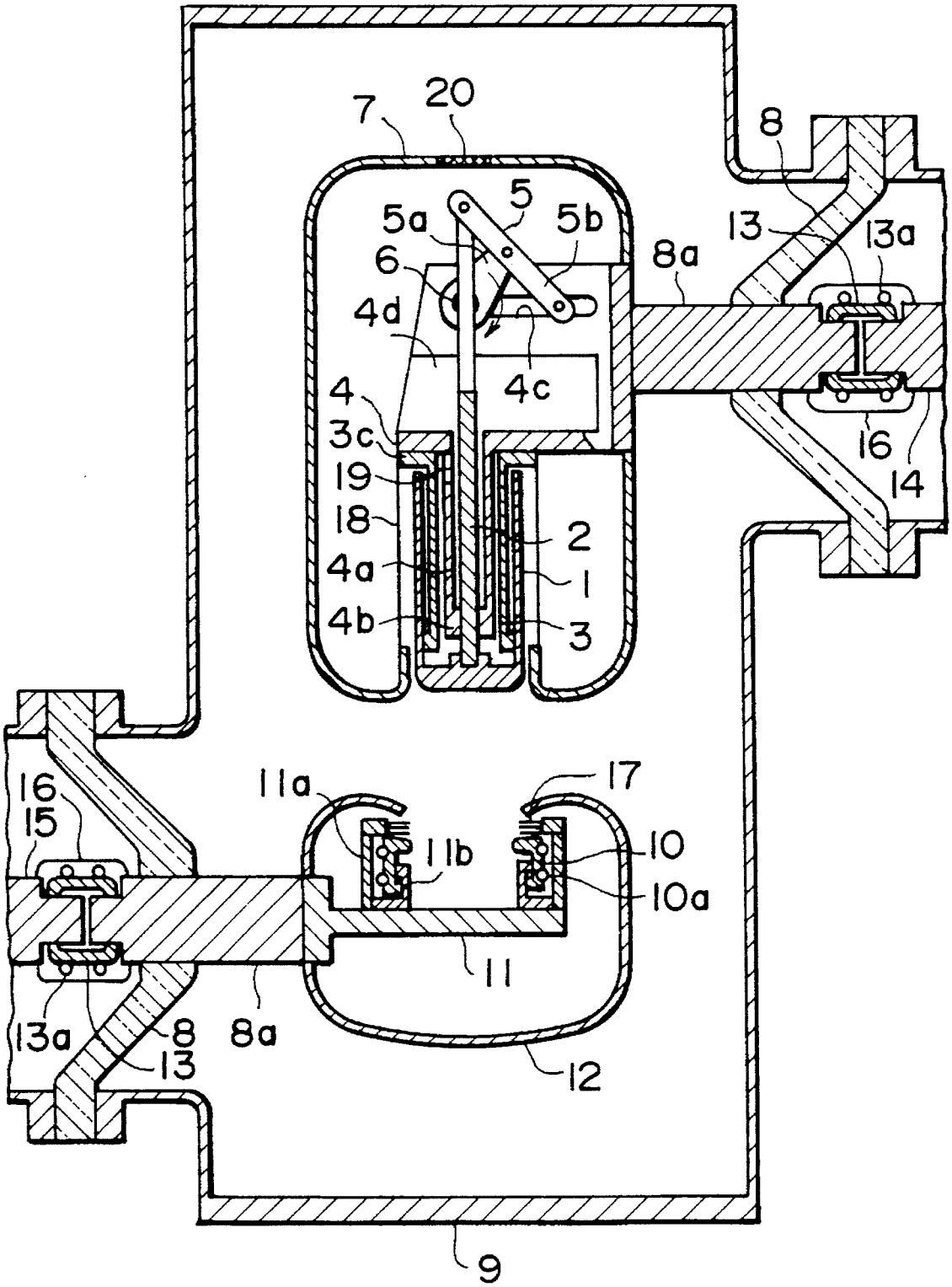
FIG. 1 is a sectional view of a gas-insulated disconnector according to an embodiment of this invention.

FIG. 1 is a sectional view of a gas-insulated disconnector according to an embodiment of this invention. In the configuration shown in FIG. 1, a movable contact 1 is disposed above a fixed contact 10. A closed hollow cylinder-shaped housing 9 is filled with an insulating gas such as $SF_6$.

To a bottom a cup-shaped movable contact 1 is coupled an operating rod 2 at the lower end thereof. A finger-type sliding contact 3, consisting of a plurality of thin resilient contact fingers supported at the top end thereof, is fitted within the movable contact 1, such that the sliding contact 3 is urged upon the interior side surface of the movable contact 1 at the outer bottom ends of the fingers. The sliding contact 3 is made from a hollow cylinder of copper-chromium alloy, etc., forming a plurality of slits from the bottom to the top of the cylinder. A plurality of resilient cantilever fingers supported at the top of the cylinder are thus formed. The sliding contact 3 is secured to a support member 4 at the top base flange 3*c* portion thereof. The metallic support member 4 has a support cylinder 4*a* extending downward within the sliding contact 3, which supports the operating rod 2 at the bottom sliding bearing portion 4*b* thereof.

A Scott-Russel type link mechanism 5 consists of a rotating link 5*a* supported on a rotational axis 6 and a link rod 5*b* pivoted at a center thereof to the outer end of the rotating link 5*a*. The top end of the operating rod 2 is pivoted to one end of the link rod 5*b*, the other end of the link rod 5*b* being slidably coupled to a sliding slit 4*c* formed horizontally in the support member 4. Thus when the rotating link 5*a* rotates clockwise in the direction of the arrow in the figure, the link rod 5*b* rotates counter-clockwise to translate the operating rod 2 vertically downward. Similarly, the counter-clockwise rotation of the rotating link 5*a* causes an upward movement of the operating rod 2. The rotational axis 6, extending perpendicular to the sheet of the drawing, is coupled to an operation device (not shown) through an insulating rotation rod (not shown).

A hollow cylindrical shield 7 secured to the support member 4 surrounds the movable contact 1 and the support member 4. A thin hollow cylindrical partition 18, secured to the periphery of the bottom opening of the shield 7 at the bottom end thereof, and to the side of the base flange 3*c* of the sliding contact 3 at the top end thereof, surrounds the movable contact 1 across a small gap when the movable contact 1 is moved upward. The top of the shield 7 is provided with a filter 20 for allowing a gas flow through. Further, the interior of the shield 7 communicates with the space within the movable contact 1 through the bore 4*d* of the support member 4 and the gas passage window 19 formed in the support cylinder 4*a*.

The upper support member 4 is secured to a central conductor 8*a* centrally extending through and supported by an insulating spacer 8 hermetically sealing an upper opening of the housing 9. The central conductor 8*a* is electrically coupled to a conductor 14 of a neighboring electrical apparatus (not shown) through a ring-shaped sliding contact 13 urged upon the central conductor 8*a* and the conductor 14 of the neighboring apparatus by a helical spring 13*a*. The sliding contact 13 is covered by a shield 16.

Upon a bottom support member 11 is fixed an outer support cylinder 11*a* and an inner support cylinder 11*b*. A tulip-type fixed contact 10 is urged upon the outer side of the inner support cylinder 11*b* by means of a helical spring 10*a*. When the movable contact 1 moves downward and received into the fixed contact 10, the top inner ridge of the fixed contact 10 is urged upon the outer side surface of the movable contact 1 by means of the helical spring 10*a*. A ring-shaped particles remover 17, provided, for example, with a brush directed inward, is attached on the top end of the outer support cylinder 11*a*. When the movable contact 1 moves upward from the closed position thereof contacting with the fixed contact 10, the brush removes the small metal particles from the movable contact 1, which are generated by the abrasion of the silver-plated contact surfaces of the movable contact 1 and the fixed contact 10. Preferably, the brush of the particles remover 17 is made of thin lines of an insulating material such as a synthetic resin. Instead of the brush, the particles remover 17 may be provided with a ring-shaped lip made of a synthetic rubber or resin bearing upon the outer surface of the movable contact 1 received into the fixed contact 10. Then a plurality of slits may be formed in the lip to improve the particle removing efficiency. The particles remover 17 may be provided with a plurality of such lips.

A lower shield 12 secured to the support member 11 surrounds the fixed contact 10 and the support member 11. The support member 11 is fixed to and electrically coupled to the lower central conductor 8*a* centrally extending through and supported by an insulating spacer 8 hermetically sealing a lower opening of the housing 9. The central conductor 8*a* is electrically coupled to a conductor 15 of a neighboring apparatus (not shown) through a ring-shaped sliding contact 13 urged upon the central conductor 8*a* and the conductor 15 of the neighboring apparatus by a helical spring 13*a*. The sliding contact 13 is covered by a shield 16.

The method of operation of the gas-insulated disconnector of FIG. 1 is as follows. FIG. 1 shows the disconnector in the open state. Upon receiving a closing or making signal, the operation device (not. shown) rotates the insulating rod (not shown) to turn the rotational axis 6 clockwise in the direction of the arrow. Thus the rotating link 5*a* rotates clockwise, to turn the link rod 5*b* counter-clockwise. As a result, the operating rod 2 is translated downward together with the movable contact 1. The movable contact 1 is thus received into the fixed contact 10 against the inward-directed urging force of the helical spring 10*a*, and the circuit between the upper conductor 14 and the lower conductor 15 is closed through: the upper sliding contact 13, the upper central conductor 8*a*, the support member 4, the sliding contact 3, the movable contact 1, the fixed contact 10, the support member 11, the lower central conductor 8*a*, and the lower sliding contact 13.

During the downward movement of the movable contact 1, the movable contact 1 slides upon the sliding contact 3. The contact surfaces are usually silver-plated to improve the contact efficiency. The abrasion of the silver-plated surfaces at the sliding contact generates small metal particles. However, since the sliding contact 3 is in contact with the interior of the cup-shaped movable contact 1, the metal particles are contained within the movable contact 1 and do not drift into the gas-insulated space between the movable contact 1 and the fixed contact 10. The portion of the operating rod 2 in sliding contact with the support cylinder 4*a* is also within the movable contact 1, and thus the metal particles generated by the abrasion thereat are contained within the movable contact 1. The partition 18 surrounding the movable contact 1 is also effective in confining the metal particles.

By the way, when the movable contact 1 moves downward, a negative pressure is created in the space within the movable contact 1. Thus the gas within the shield 7 flows into the space within the movable contact 1 through the gas passage window 19 and the bore 4*d* of the support member 4. The negative pressure thus created within the shield 7 is compensated for by the gas flowing thereinto through the filter 20.

The contacts of the disconnector in the closed state as described above are opened as follows. Upon receiving an opening or breaking signal, the operation device (not shown) rotates the insulating rod (not shown) to turn the rotational axis 6 counter-clockwise in the direction opposite to the arrow. Thus the rotating link 5*a* rotates counter-clockwise, to turn the link rod 5*b* clockwise. As a result, the operating rod 2 is translated upward together with the movable contact 1, and the movable contact 1 is separated from the fixed contact 10. The disconnector thus finally reaches the open state shown in FIG. 1. During the opening process, the fixed contact 10 slides upon the upward moving movable contact 1, thereby generating small metal particles. The particles remover 17, however, removes the small metal particles from the out-going movable contact 1, such that the metal particles fall into and contained within the shield 12. The metal particles thus do not drift into the gas-insulated space between the movable contact 1 and the fixed contact 10. The sliding contact portions between the movable contact 1 and the sliding contact 3 and between the operating rod 2 and support cylinder 4*a* of the support member 4 are contained within the movable contact 1, such that the small metal particles generated thereat do not drift into the gas-insulated space either. The good insulating condition can thus be maintained for a prolonged service period.

Figure 2:
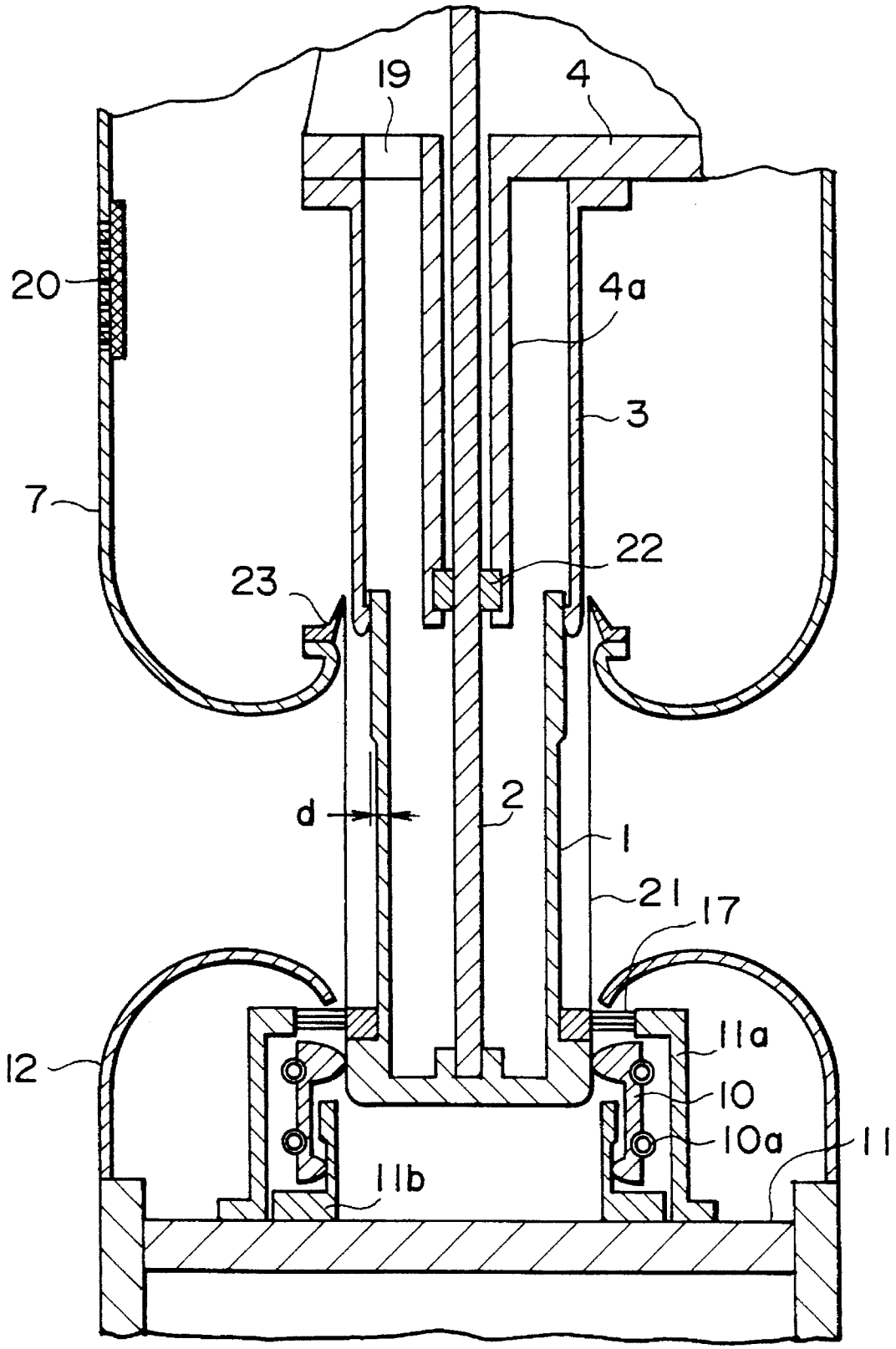
FIG. 2 is a partial enlarged sectional view of a gas-insulated disconnector according to another embodiment of this invention.

FIG. 2 is a partial enlarged sectional view of a gas-insulated disconnector according to another embodiment of this invention. The parts not shown in FIG. 2 are similar to those of FIG. 1. The method of operation of the gas-insulated disconnector of FIG. 2 is similar to that of the gas-insulated disconnector of FIG. 1 except where stated otherwise below.

According to the embodiment of FIG. 2, the sliding contact 3 contacts upon the outer side surface of the cup-shaped movable contact 1 at the inner bottom ridge thereof. As shown in the Figure, the sliding contact 3 is preferred to be of the finger-type consisting of a plurality of resilient contact fingers supported at the top base portion thereof in the form of cantilevers. The sliding contact 3 may also be of the tulip-type. A thin outer cylindrical cover 21 attached to the movable contact 1 at the bottom end thereof surrounds the movable contact 1, such that the sliding contact 3 is received into the space between the outer cylindrical cover 21 and the movable contact 1 when the movable contact 1 is moved upward. A ring-shaped sealing member 23 made of a synthetic rubber or resin and secured to the ridge of the bottom opening of the shield 7 is provided with a lip bearing and sliding upon the outer side surface of the outer cylindrical cover 21. The lip of the sealing member 23 may be replaced by a brush directed slantwise upward. The small metal particles generated by the abrasion of the sliding contact surfaces between the movable contact 1 and sliding contact 3 are trapped in the outer cylindrical cover 21, and do not drift into the gas-insulated space between the contacts 1 and 10. The outer cylindrical cover 21 may be formed integrally with the movable contact 1, such that the movable contact 1 has the form of a double-sided cylinder.

A rein bearing 22 made, for example, of tetrafluoroethylene, fixed to the support cylinder 4*a* of the support member 4, slidably supports the operating rod 2 and eliminates the need for the supply of lubricating oil between the operating rod 2 and the support cylinder 4*a*. The maintenance is thus simplified.

The geometry of FIG. 2 has the advantage that the electromagnetic force generated by a large current flowing through the sliding contact 3 upon making of the movable and fixed contacts 1 and 10 urges the fingers of the sliding contact 3 upon the movable contact 1, and thereby improves the conduction efficiency.

Further, in the case of the gas-insulated disconnector of FIG. 2, the outer side of the movable contact 1 is stepped with a reduction d, except for a predetermined top height. The outer side surfaces of the top enlarged outer diameter portion and the bottom reduced diameter portion of the movable contact 1 are connected by a tapered surface. When the movable contact 1 is moved upward to the open position, the force with which the sliding contact 3 urges upon the movable contact 1 is reduced due to the reduction d of the diameter of the lower portion of the movable contact 1, and the abrasion of the surfaces in sliding contact is thereby effectively reduced. When, on the other hand, the movable contact 1 moves to the bottom position in contact with the fixed contact 10, the enlarged diameter of the top portion of the movable contact 1 ensures a secure contact of the sliding contact 3 with the movable contact 1. It is noted that a similar geometry of the movable contact 1 may be adopted in other embodiments.

In the configuration of FIG. 2, a gas passage window 19 formed in the support member 4 communicates the interior of the movable contact 1 with the interior of the shield 7, which in turn communicates with the space outside thereof through a filter 20.

Figure 3:
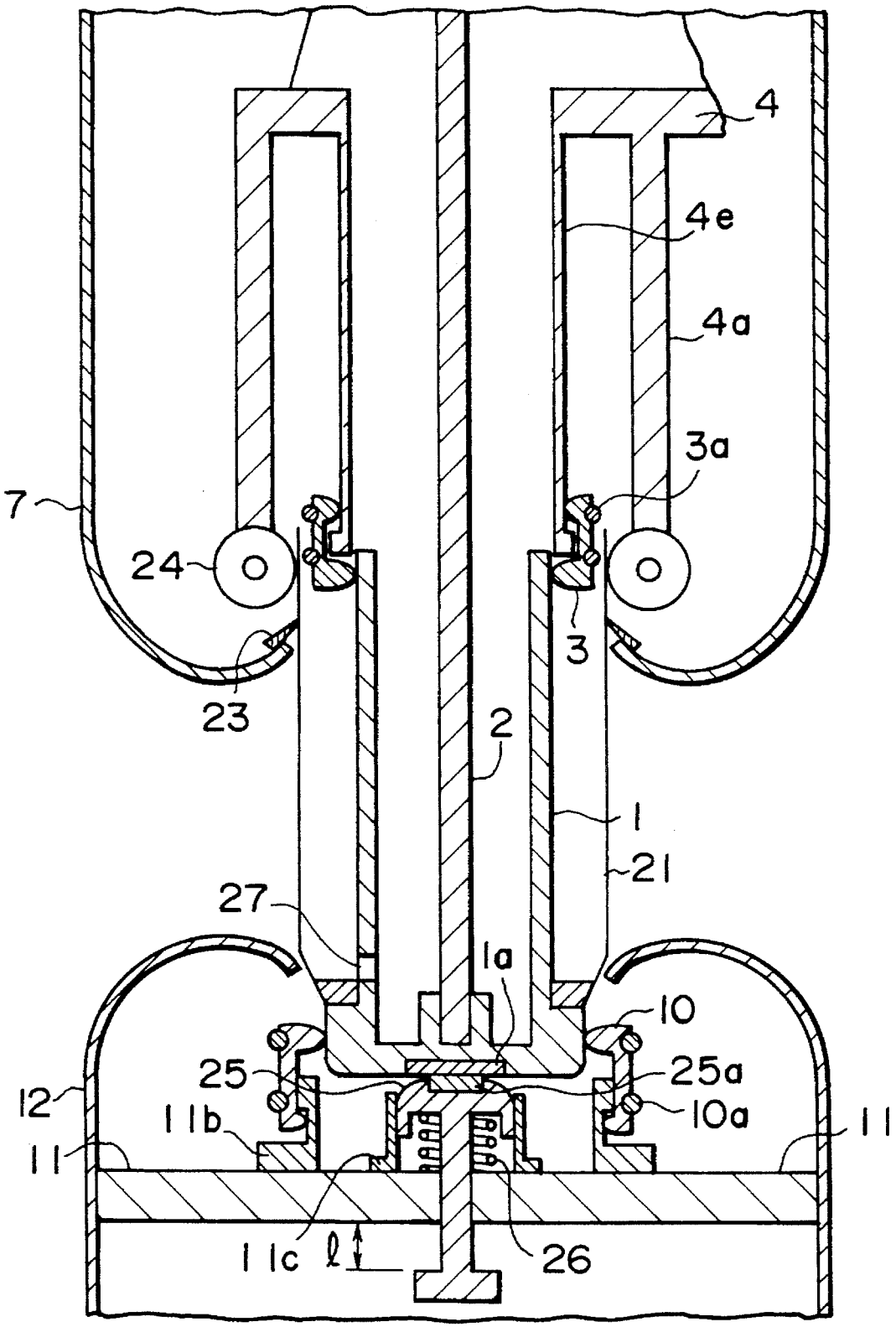
FIG. 3 is a partial enlarged sectional view of a gas-insulated disconnector according to still another embodiment of this invention.

FIG. 3 is a partial enlarged sectional view of a gas-insulated disconnector according to still another embodiment of this invention. The structure and the method of operation of the gas-insulated disconnector of FIG. 3 are similar to those of the gas-insulated disconnector of FIG. 1 or 2 except where stated otherwise below.

In FIG. 3, the support cylinder 4*a* surrounding the inner cylinder 4*e* is provided with rollers 24 at the bottom end thereof, which are in rolling contact with the outer side of the outer cylindrical cover 21 and thus support the movable contact 1 and the outer cylindrical cover 21. The rollers 24 are made of an insulating synthetic resin exhibiting a small friction coefficient, such as tetrafluoroethylene. The sliding contact 3 carried on the bottom end of the inner cylinder 4*e* is urged upon the support cylinder 4*a* and the movable contact 1 by means of the helical spring 3*a*. The sliding contact 3 and the inner cylinder 4*e* are received into the space between the outer cylindrical cover 21 and the movable contact 1 when the movable contact 1 is moved upward.

Further, an arcing contact 25 is disposed at the center of the support cylinder 11*b*. The arcing contact 25, having an axis vertically extending through and slidably supported by the support member 11, is provided with a head sliding within an inner support cylinder 11*c*. When the movable contact 1 is moved upward from the state in contact with the fixed contact 10, the helical spring 26, bearing upon the lower surface of the head of the arcing contact 25, urges the arcing contact 25 upward by a predetermined length l. Thus, the arcing contact 25 and the movable contact 1 remain in contact, until the movable contact 1 is completely separated from the fixed contact 10, thereby suppressing the generation of arc between the fixed contact 10 and the movable contact 1. Thus the consumption of the contact surfaces between the movable contact 1 and the fixed contact 10 due to the generation of an arc between the fixed contact 10 and the movable contact 1 is effectively reduced. The contacting portions 1*a* and 25*a* of the movable contact 1 and the arcing contact 25 are made of an arc-resistant metal. The provision of the arcing contact 25 is particularly effective for disconnectors by which large currents are to be interrupted.

In the case of the embodiment of FIG. 3, the particles remover 17 shown in FIGS. 1 and 2 is not provided. However, since the movable contact 1 is disposed above the fixed contact 10, most of the small metal particles generated by the abrasion of the contact surfaces between the movable contact 1 and the fixed contact 10 fall into and are contained in the shield 12. Thus the insulation efficiency of the insulating gas can be maintained below a practically allowable level for a prolonged service period. A gas passage window 27 is formed through the side wall of the movable contact 1, to facilitate the gas flow between the space between the movable contact 1 and the outer cylindrical cover 21 and the space within the movable contact 1. The electrical current which flows upon making of the contacts raises the temperature thereof. The gas flow through the gas passage window 27 is effective in cooling the heated portions, and thus improves the conducting efficiency.

Figure 4:
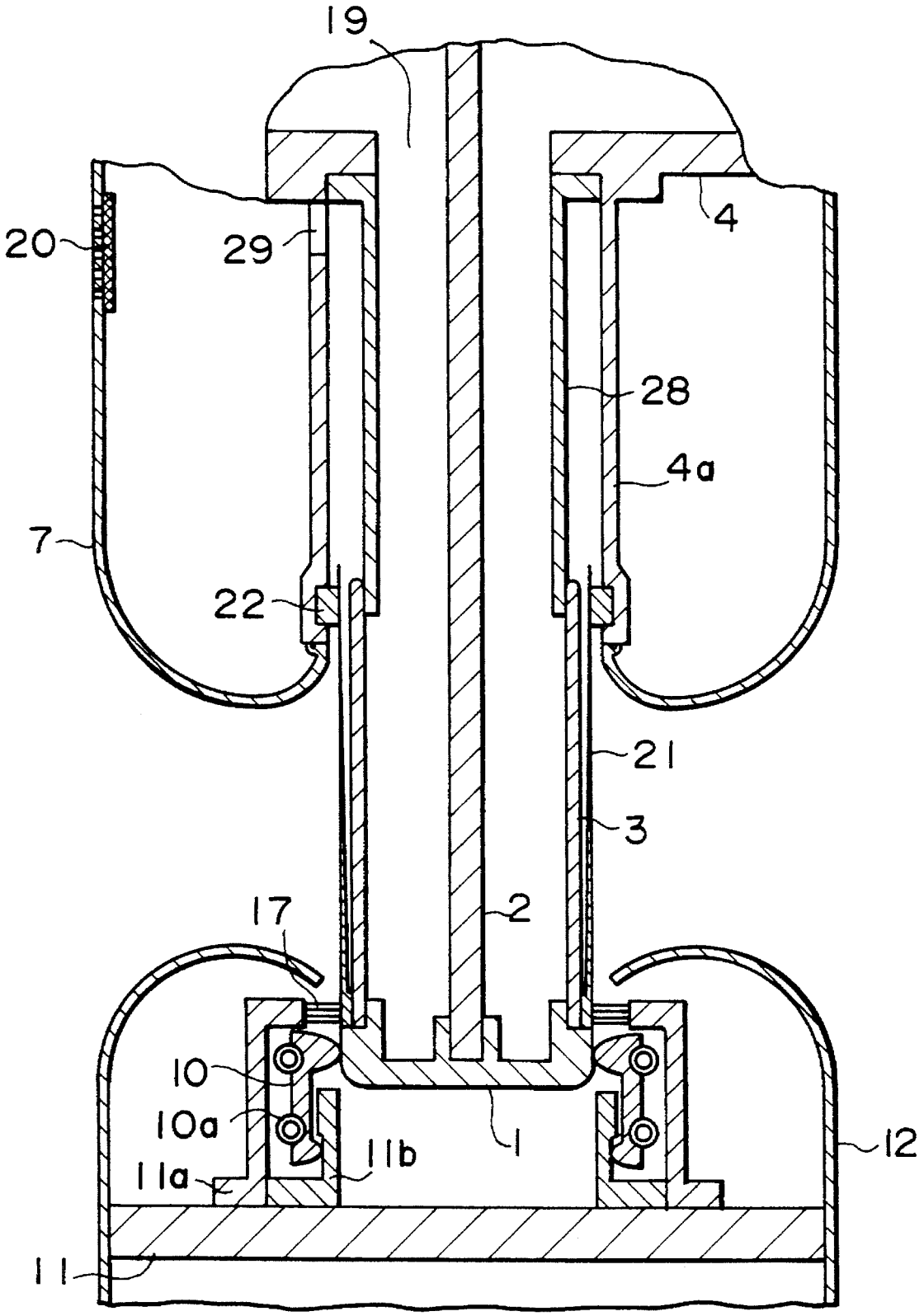
FIG. 4 is a partial enlarged sectional view of a gas-insulated disconnector according to a further embodiment of this invention.

FIG. 4 is a partial enlarged sectional view of a gas-insulated disconnector according to a further embodiment of this invention. The structure and the method of operation of the gas-insulated disconnector of FIG. 4 are similar to those of the embodiments above except where stated otherwise below.

In FIG. 4, a sliding contact 3, consisting of a plurality of contact fingers supported at the bottom end thereof in the form of cantilevers, is fixed at the bottom end thereof to a substantially disk-shaped movable contact 1. The sliding contact 3 contact with the outer side of a cylindrical sliding electrode 28 fixed to the support member 4 at the top base flange thereof. The support cylinder 4*a* is provided with a ring-shaped resin bearing 22 made of an insulating material for sealing and slidably supporting the outer side surface of the outer cylindrical cover 21 fixed to the movable contact 1 at the bottom end thereof. A gas passage window 19 communicates the space within the cylindrical sliding electrode 28 with the space within the shield 7. Further, a gas passage window 29 formed in the support cylinder 4*a* communicates the space between the support cylinder 4*a* and the cylindrical sliding electrode 28 with the space within the shield 7. The ridge of the bottom opening of the shield 7 is coupled without a gap to the bottom end of the support cylinder 4*a* of the support member 4. When the contacts are made, the fingers of the sliding contact 3 are urged upon the cylindrical sliding electrode 28 by the electromagnetic force generated by the current flowing through the sliding contact 3. Thus, a large current can be conducted with small loss of power.

Figure 5:
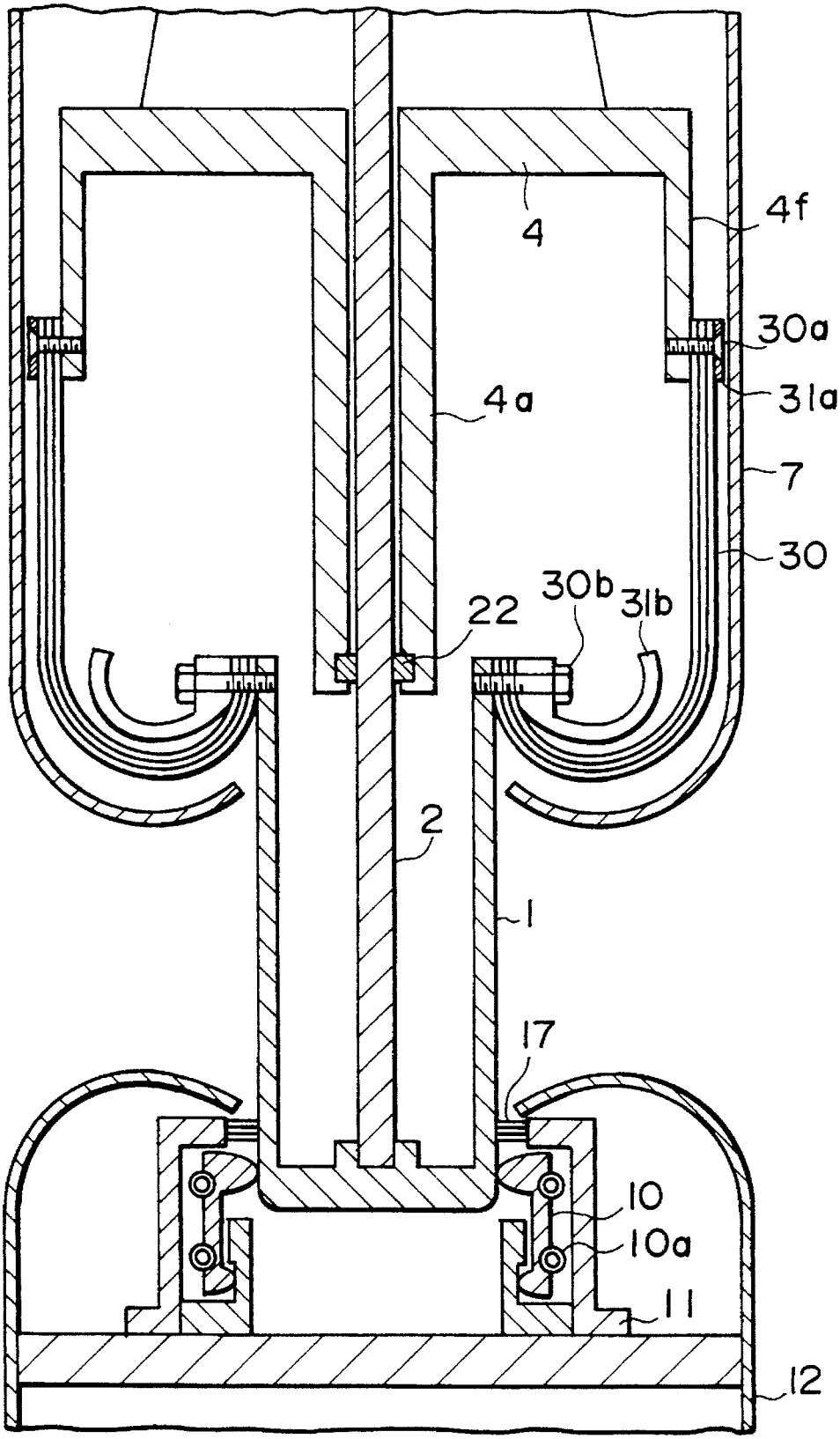
FIG. 5 is a partial enlarged sectional view of a gas-insulated disconnector according to a still further embodiment of this invention.
Figure 6:
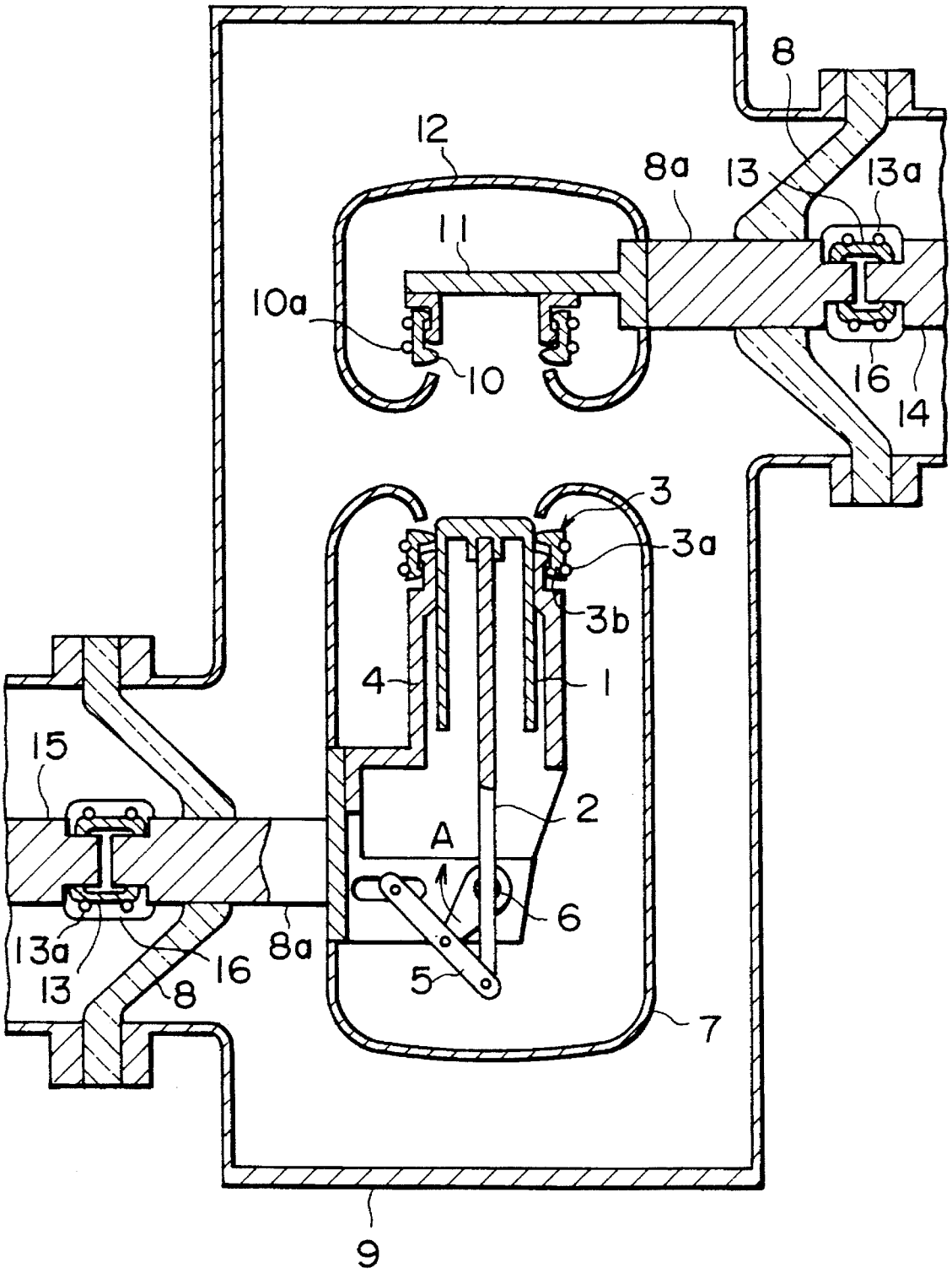
FIG. 6 PRIOR ART
FIG. 6 is a sectional view of a conventional gas-insulated disconnector.

FIG. 5 is a partial enlarged sectional view of a gas-insulated disconnector according to a still further embodiment of this invention. The structure and the method of operation of the gas-insulated disconnector of FIG. 5 are similar to those of the embodiments above except where stated otherwise below.

Flexible conductors 30, consisting of a plurality of bands each made of a plurality of flexible metal ribbons superposed on one another, are attached at the top ends thereof to the cylindrical projection 4*f* of the support member 4 by means of fixing screws 30*a* and washers 31*a*, and to the top end of the cup-shaped movable contact 1 at the bottom ends thereof by means of fixing screws 30*b* and washers 31*b*. The bands of the flexible conductors 30 extend vertically downward from the cylindrical projection 4*f* and are turned inwards to extend radially toward the movable contact 1. Since the electrical connection between the movable contact 1 and the support member 4 is secured through the flexible conductors 30 without using surfaces in sliding contact, the generation of small metal particles is suppressed. Otherwise, the structure has similar advantages as those of the above embodiments.

All the above embodiments of the gas-insulated disconnector according to this invention are of the vertical type by which the longitudinal direction of the disconnector runs vertically. This invention, however, can be applied to gas-insulated disconnectors of the horizontal type by which the longitudinal direction of the disconnector runs horizontally. In such case, the provision of the particles remover 17 in the neighborhood of the fixed contact 10 is preferred even if it is not shown in the figure. It is further noted that although the above embodiments relate to gas-insulated disconnectors, this invention can be applied to any types of switchgears.

What is claimed is:

1. A gas-insulated switchgear for disconnecting an electrical connection between a first outside conductor and a second outside conductor, said gas-insulated switchgear comprising:

a housing filled with an insulating gas;

a fixed contact disposed within said housing and electrically coupled to said first outside conductor;

a shield substantially surrounding said fixed contact;

an electrically conducting support member disposed within said housing and electrically coupled to said second outside conductor;

a sliding contact secured on and electrically coupled to said support member;

a cup-shaped movable contact in sliding contact with said sliding contact at an inner side surface thereof, said movable contact being engageable with said fixed contact;

link means operatively coupled to said movable contact, for moving said movable contact between a first position electrically in contact with said fixed contact and a second position separated from said fixed contact across a gap filled with said insulating gas; and a particle remover disposed within said shield near said fixed contact for removing particles from an outer surface of said movable contact.

2. A gas-insulated switchgear as claimed in claim 1, further comprising:

an operating rod connecting said movable contact to said link means; and a support cylinder fixed to said support member and slidably supporting said operating rod, wherein said support cylinder is situated substantially within said movable contact while said movable contact is moved between said first and second positions.

3. A gas-insulated switchgear for disconnecting an electrical connection between a first outside conductor and a second outside conductor, said gas-insulated switchgear comprising:

a housing filled with an insulating gas;

a fixed contact disposed within said housing and electrically coupled to said first outside conductor;

an electrically conducting support member disposed within said housing and electrically coupled to said second outside conductor;

a sliding contact supported on and electrically coupled to said support member;

a cylindrical movable contact in sliding contact with said sliding contact at an outer side surface thereof;

link means operatively coupled to said movable contact, for moving said movable contact between a first position electrically in contact with said fixed contact and a second position separated from said fixed contact across a gap filled with said insulating gas; and an outer cylindrical cover fixed to said movable contact at a bottom end thereof and surrounding said movable contact so as to define a gap between the outer side surface of said movable contact and an inner surface of said outer cylindrical cover, wherein portions of said sliding contact in sliding contact with said movable contact are received within said gap between said movable contact and said outer cylindrical cover and are spaced from said inner surface of said outer cylindrical cover, while said movable contact is moved between said first and second positions, such that particles generated by the sliding contact between said movable contact and said sliding contact are trapped in said outer cylindrical cover.

4. A gas-insulated switchgear as claimed in claim 3, wherein said sliding contact includes contact fingers supported at a base of said sliding contact in forms of cantilevers, said base of said sliding contact being fixed to said support member.

5. A gas-insulated switchgear as claimed in claim 3, wherein a diameter of said outer side surface of said movable contact is stepped with a predetermined reduction except for a predetermined length of an end portion of said movable contact situated away from said fixed contact.

6. A gas-insulated switchgear as claimed in claim 4, further comprising:

an operating rod connecting said movable contact to said link means; and a support cylinder fixed to said support member and slidably supporting said operating rod, wherein said support cylinder is situated substantially within said movable contact while said movable contact is moved between said first and second positions.

7. A gas-insulated switchgear as claimed in claim 3, wherein:

said support member includes a cylindrical projection; and said sliding contact includes a ring-shaped sliding contact member supported on and electrically in contact with an end of said projection, said ring-shaped sliding contact member being in sliding contact with said movable contact.

8. A gas-insulated switchgear as claimed in claim 7, further comprising:

an outer support cylinder fixed to said support member and surrounding said cylindrical projection;

rollers rotatably supported at an end of said outer support cylinder to roll upon an outer side surface of said outer cylindrical cover to translatably support said outer cylindrical cover.

9. A gas-insulated switchgear as claimed in claim 3, further comprising:

a shield substantially surrounding said fixed contact; and a particles remover disposed within said shield near said fixed contact for removing metal particles from an outer surface of said movable contact.

10. A gas-insulated switchgear for disconnecting an electrical connection between a first outside conductor and a second outside conductor, said gas-insulated switchgear comprising:

a housing filled with an insulating gas;

a fixed contact disposed within said housing and electrically coupled to said first outside conductor;

an electrically conducting support member disposed within said housing and electrically coupled to said second outside conductor;

a cylindrical sliding electrode coupled to said support member at a base thereof;

a movable contact disposed in said housing;

a sliding contact supported on said movable contact and in sliding contact with said cylindrical sliding electrode;

link means operatively coupled to said movable contact, for moving said movable contact between a first position electrically in contact with said fixed contact and a second position separated from said fixed contact across a gap filled with said insulating gas;

an outer cylindrical cover fixed to said movable contact at a bottom end thereof and surrounding said sliding contact, wherein portions of said sliding contact in sliding contact with said movable contact are received within said outer cylindrical cover while said movable contact is moved between said first and second positions;

a shield substantially surrounding said fixed contact; and a particles remover disposed within said shield near said fixed contact for removing metal particles from an outer surface of said movable contact.

11. A gas-insulated switchgear for disconnecting an electrical connection between a first outside conductor and a second outside conductor, said gas-insulated switchgear comprising:

a housing filled with an insulating gas;

a fixed contact disposed within said housing and electrically coupled to said first outside conductor;

an electrically conducting support member disposed within said housing and electrically coupled to said second outside conductor;

a movable contact disposed within said housing;

link means operatively coupled to said movable contact, for moving said movable contact between a first position electrically in contact with said fixed contact and a second position separated from said fixed contact across a gap filled with said insulating gas;

flexible conductors electrically connecting said movable contact with said support member;

a shield substantially surrounding said fixed contact; and a particles remover disposed within said shield near said fixed contact for removing metal particles from an outer surface of said movable contact.

12. A gas-insulated switchgear as claimed in claim 11, wherein said flexible conductors comprise a plurality of bands made of a plurality of flexible ribbons attached to each other.

13. A gas-insulated switchgear for disconnecting an electrical connection between a first outside conductor and a second outside conductor, said gas-insulated switchgear comprising:

a housing filled with an insulating gas;

a fixed contact disposed within said housing and electrically coupled to said first outside conductor;

a shield substantially surrounding said fixed contact;

an electrically conducting support member disposed within said housing and electrically coupled to said second outside conductor;

a resilient sliding contact secured on and electrically coupled to said support member;

a cup-shaped movable contact in sliding contact with said resilient sliding contact, said resilient sliding contact being fitted within said movable contact such that said resilient sliding contact is radially outwardly urged against an interior surface of said movable contact; and link means operatively coupled to said movable contact, for moving said movable contact relative to said resilient sliding contact between a first position electrically in contact with said fixed contact and a second position separated from said fixed contact across a gap filled with said insulating gas.

* * * * *